US011306723B2

(12) United States Patent
Pawellek

(10) Patent No.: US 11,306,723 B2
(45) Date of Patent: Apr. 19, 2022

(54) COOLANT PUMP HAVING AN OPTIMIZED BEARING ASSEMBLY AND IMPROVED HEAT BALANCE

(71) Applicant: NIDEC GPM GMBH, Auengrund OT Merbelsrod (DE)

(72) Inventor: Franz Pawellek, Lautertal (DE)

(73) Assignee: NIDEC GPM GMBH, Auengrund OT Merbelsrod (DE)

( * ) Notice: Subject to any disclaimer, the term of this patent is extended or adjusted under 35 U.S.C. 154(b) by 160 days.

(21) Appl. No.: 16/961,676

(22) PCT Filed: Nov. 21, 2018

(86) PCT No.: PCT/EP2018/082035

§ 371 (c)(1),
(2) Date: Jul. 11, 2020

(87) PCT Pub. No.: WO2019/161950

PCT Pub. Date: Aug. 29, 2019

(65) Prior Publication Data

US 2021/0079920 A1 Mar. 18, 2021

(30) Foreign Application Priority Data

Feb. 22, 2018 (DE) ..... 10 2018 104 015.6

(51) Int. Cl.
*F04D 13/06* (2006.01)
*F04D 29/04* (2006.01)
(Continued)

(52) U.S. Cl.
CPC ..... *F04D 13/0633* (2013.01); *F01P 5/12* (2013.01); *F04D 13/12* (2013.01); *F04D 29/043* (2013.01);
(Continued)

(58) Field of Classification Search
CPC .... F04D 13/06; F04D 29/061; F04D 13/0633; F04D 13/0673; F04D 29/046;
(Continued)

(56) References Cited

U.S. PATENT DOCUMENTS 6,485,256 B1 11/2002 Iketani
9,188,128 B2 * 11/2015 Lee ..... F04D 13/06
(Continued)

FOREIGN PATENT DOCUMENTS

CN 1484737 A 3/2004
CN 1485544 A 3/2004
(Continued)

OTHER PUBLICATIONS

The International Preliminary Report on Patentability of the International Searching Authority, issued in PCT/EP2018/082035, dated Aug. 27, 2020.
(Continued)

*Primary Examiner* — Long T Tran
(74) *Attorney, Agent, or Firm* — Harness, Dickey & Pierce, P.L.C.

(57) ABSTRACT

An electrical coolant pump, preferably for use as an additional water pump in a vehicle, is characterised in that a radial bearing of the shaft, which is arranged between the pump impeller and the rotor, is provided by means of a radial sintered sliding bearing having a defined porosity lubricated by coolant, and a shaft seal is arranged between the radial sliding bearing and the motor chamber, wherein at least one coolant flow channel with a predetermined depth is provided in the sintered sliding bearing in an axial direction extending from the end of the sintered sliding bearing on the side of the pump chamber.

11 Claims, 1 Drawing Sheet

(51) Int. Cl.

| | |
|---|---|
| ***F01P 5/10*** | (2006.01) |
| ***F01P 5/12*** | (2006.01) |
| ***F04D 13/12*** | (2006.01) |
| ***F04D 29/043*** | (2006.01) |
| ***F04D 29/046*** | (2006.01) |
| ***F04D 29/06*** | (2006.01) |
| ***F04D 29/10*** | (2006.01) |

(52) U.S. Cl.
CPC ..... *F04D 29/046* (2013.01); *F04D 29/061* (2013.01); *F04D 29/106* (2013.01); *F01P 2005/105* (2013.01); *F01P 2005/125* (2013.01)

(58) Field of Classification Search
CPC .... F04D 29/106; F04D 1/00; F01P 2005/125; F01P 5/10; F01P 5/12
See application file for complete search history.

(56) References Cited

U.S. PATENT DOCUMENTS

| | | | | |
|---|---|---|---|---|
| 2014/0271279 | A1* | 9/2014 | Kuba | F04D 13/0606 417/420 |
| 2015/0033787 | A1* | 2/2015 | Aso | H02K 5/08 29/598 |
| 2016/0025092 | A1 | 1/2016 | Miyagawa et al. | |
| 2016/0265538 | A1* | 9/2016 | Lee | F04D 29/669 |
| 2017/0082117 | A1* | 3/2017 | Zhou | F04D 13/0686 |

FOREIGN PATENT DOCUMENTS

| | | | |
|---|---|---|---|
| CN | 1576607 | A | 2/2005 |
| CN | 202108767 | | 1/2012 |
| CN | 102562605 | A | 7/2012 |
| CN | 102606510 | A | 7/2012 |
| CN | 102741498 | A | 10/2012 |
| CN | 105298837 | A | 2/2016 |
| CN | 105443400 | A | 3/2016 |
| CN | 106062372 | A | 10/2016 |
| CN | 206159122 | U | 5/2017 |
| CN | 107404176 | A | 11/2017 |
| DE | 10012662 | A1 | 9/2001 |
| DE | 10221843 | A1 | 12/2003 |
| DE | 202005019163 | U1 | 4/2006 |
| WO | WO-2015121052 | A1 | 8/2015 |
| WO | WO-2017036837 | A1 | 3/2017 |

OTHER PUBLICATIONS

English Translation of Office Action issued in Chinese Application No. 2018800867855, dated Feb. 10, 2021.
Office Action issued in DE102018104015.6, dated Nov. 28, 2018.
International Search Report and Written Opinion of the International Searching Authority, issued in PCT/EP2018/082035, dated Jan. 10, 2019; ISA/EP.

* cited by examiner

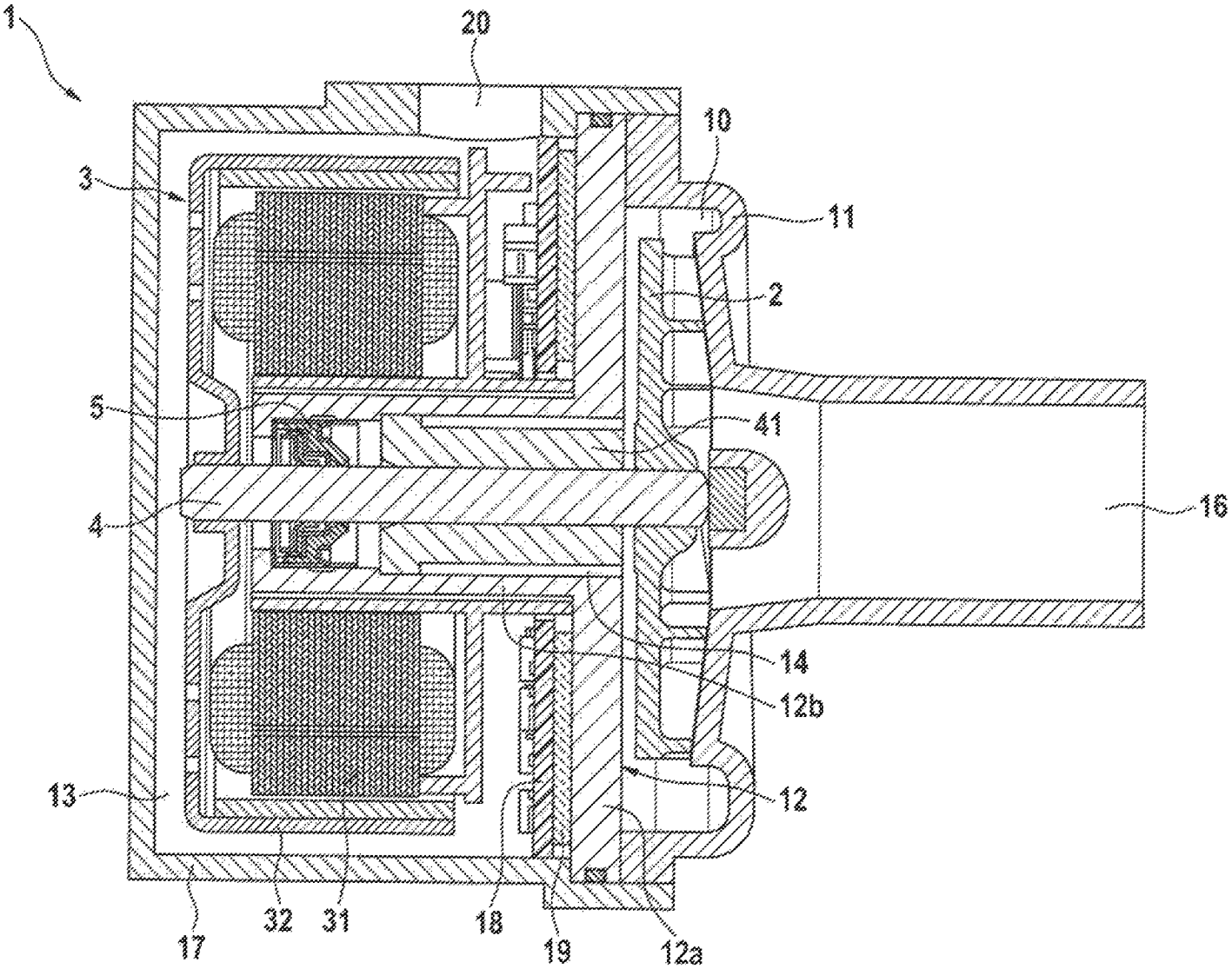
1
3
5
4
13
20
10
11
2
41
14
12b
12
12a
16
19
18
31
32
17

COOLANT PUMP HAVING AN OPTIMIZED BEARING ASSEMBLY AND IMPROVED HEAT BALANCE

CROSS-REFERENCE TO RELATED APPLICATIONS

This application is a 371 U.S. National Phase of International Application No. PCT/EP2018/082035, filed Nov. 21, 2018, which claims priority to German Patent Application No. 10 2018 104 015.6, filed Feb. 22, 2018. The entire disclosures of the above applications are incorporated herein by reference.

The present invention relates to an electrical coolant pump, the structure of which is optimised in relation to cost, installation space and service life in the field of application of an additional water pump by a combination of a mounting, seal and electric motor, and which has a bearing arrangement, which is optimised taking the field of application into consideration, and improved thermal efficiency.

Such electrical additional water pumps are used for the circulation of partial regions of a coolant-conveying thermal management system of a vehicle which is equipped with a combustion machine and a main water pump in order to more flexibly cool so-called hotspots on components of auxiliary devices, such as on an exhaust gas recirculation system, on a turbocharger, on a charge air cooling system or the like. The redundancy with respect to the main water pump and the increased number of lines and nodal points means that such additional water pumps of the type in question face significant pricing pressure as well as considerable demands for a compact design with small dimensions for integration in a complex package of modern thermal management systems.

By reason, inter alia, of the simpler sealing in the relatively small pump structure, wet runner electric motors of the inner runner type are used in hitherto established products of electrical additional water pumps. The use of wet runner electric motors, on which typically the stator is dry-encapsulated with respect to the rotor by a can or the like and the rotor and a mounting are designed for operation in the medium to be conveyed, represents a known measure for overcoming the problem of a leakage on a shaft seal and a defect of a shaft mounting.

However, wet runners have a lower level of efficiency because the gap between the stator and the rotor for accommodating a can turns out to be larger and a field strength acting upon the rotor is consequently attenuated. Moreover, liquid friction occurs on the rotor, whereby the level of efficiency decreases further specifically in the case of the relatively small-dimensioned pump drives of additional water pumps. Furthermore, wet runners encounter problems at low temperatures, such as icing in the gap between the stator and the rotor.

By reason of the improved level of efficiency, dry runner electric motors are also used on larger pumps, such as the electrical main water pumps. In order to mount pump shafts which are driven by a dry runner electric motor, rolling body bearings, such as e.g. ball bearings are predominately used, said bearings absorbing both axial and radial loadings and achieving low friction coefficients.

However, rolling body bearings in general are sensitive to the ingress of moisture because the materials used, in particular suitable steels of rolling bodies, are not sufficiently corrosion-resistant for use in moisture. The occurrence of moisture leads, by reason of corrosion, to the reduction in the surface quality of the rolling bodies and races, which results in greater friction of the bearing and corresponding heat development and further subsequent damage on bearings and seals. As a consequence, the already cost-intensive rolling body bearings in pumps must be provided on both end sides with, once again, cost-intensive seals which ensure low-friction and reliable sealing with respect to the occurring working pressures in the pump chamber.

In addition to the cost disadvantage, corresponding seals always cause small leakages and often constitute the limiting factor for the service life of a pump because they are subjected, per se, to frictional wear and embrittlement as a result of pressure and temperature fluctuations.

Moreover, patent application DE 196 39 928 A1 discloses a mechanically driven water pump, in which a shaft connected to a pump impeller is mounted via a sintered bearing and the bearing gap is lubricated by a part of the medium to be conveyed. The disclosed water pump is used as a main water pump and is driven externally via a belt. In comparison therewith, water pumps which are used as additional water pumps place increased requirements in terms of a variable control of the conveyed volume of the pump and so a belt drive appears to be unsuitable in this regard. Moreover, the use of the belt drive means that in this known water pump, in comparison with electrical water pumps having an integrated electric motor, fundamentally different thermal conditions prevail because the thermal value introduced by integrated electric motors does not apply. This thermal value is significant particularly when using dry runner electric motors because the generated heat in this case cannot be dissipated by a medium to be conveyed flowing around the electric motor.

Moreover, in the case of conventional coolant pumps, operating states can occur in which the sliding bearing itself and furthermore heat-generating elements, such as a control unit or circuit board or the stator of the electric motor, are not sufficiently cooled.

Moreover, in the case of conventional coolant pumps having wet runner electric motors the bearing play in the sliding bearing of the shaft are set fairly large in a range of 0.1 to 0.2 mm in order to prevent impurities (particles) in the medium to be conveyed from causing jamming effects in the sliding bearing and/or the shaft sealing ring. Furthermore, this increased bearing play results in increased noise emission of the pump by reason of radial displacements of the shaft.

Furthermore, in the case of known coolant pumps, sliding bearings consisting of engineering carbon or high-grade polymers are frequently used and these materials are comparatively expensive.

Based upon the problems of the prior art which has been discussed, an object of the invention is that of providing a simple, cost-effective, durable and compact pump structure for a dry runner electric motor having improved noise emission and improved cooling.

In accordance with the invention, the object is achieved by an electrical coolant pump according to claim 1.

The electrical coolant pump is characterised particularly in that a radial bearing of the shaft, which is arranged between the pump impeller and the rotor, is provided by means of a radial sintered sliding bearing having a defined porosity lubricated by coolant (not soaked or impregnated with lubricant); and in that a shaft seal is arranged between the radial sliding bearing and the motor chamber; wherein at least one coolant flow channel with a predetermined depth is provided in the sintered sliding bearing in an axial direction extending from the end of the sintered sliding bearing on the side of the pump chamber.

The invention in its most general form is based upon the knowledge that by means of the inventive selection, combination and arrangement of the individual components of the pump, a simplified and durable mounting of the shaft and effective heat dissipation from the sliding bearing itself and from further elements arranged in the motor chamber, such as the electric motor, into the medium to be conveyed are achieved, thus producing the design and economic advantages corresponding to the objects.

Firstly, the invention makes provision to provide a radial sintered sliding bearing which is lubricated by coolant, is not soaked with lubricant and has a defined porosity and an axial coolant flow channel in an electrical coolant pump. The use of a porous sintered bearing lubricated by the medium to be conveyed is cost-effective on the one hand because the sintered bearing does not have to undergo any soaking or subsequent soaking, on the other hand the predetermined porosity of the sintered bearing in cooperation with the coolant flow channel permits a defined coolant flow through the sliding bearing and filtering of the medium to be conveyed through the sliding bearing itself. In this regard, the axial portion of the porous sintered sliding bearing, in which the coolant flow channel is not provided, serves as a filter element for the medium to be conveyed and no separate filter element has to be provided. By means of the defined coolant flow, heat from the sliding bearing itself and the elements of the pump connected thereto, such as the stator or the control unit, and also the shaft seal can be dissipated more effectively into the medium to be conveyed and therefore the thermal efficiency of the coolant pump can be improved. Moreover, the use of the sintered sliding bearing permits the setting of small bearing play because the thermal expansion of the sintered bearing and the shaft can be adapted in a suitable manner with a corresponding selection of material.

Advantageous developments of the additional water pump are provided in the dependent claims.

According to one aspect of the invention, the coolant flow channel can extend in the axial direction from the end of the sintered sliding bearing on the side of the pump chamber across about 90% of the component depth of the sintered sliding bearing.

As a result, the medium to be conveyed can be distributed rapidly and uniformly over the entire axial length of the porous sintered sliding bearing and penetrate therein, whereby lubrication of the bearing site can be ensured. Furthermore, the remaining axial end portion of the porous sintered sliding bearing which is not provided with the coolant flow channel can ensure, on the side opposite the pump chamber which occupies in the axial direction about 10% of the component depth of the sintered sliding bearing, adequate filtering of the medium to be conveyed. Furthermore, this configuration ensures that the defined coolant flow in the axial direction through the porous sliding bearing and subsequently through the bearing gap of the sliding bearing back towards the pump chamber can be set in a more reliable manner.

According to a further aspect of the invention, the bearing play in the sintered sliding bearing of the shaft can be set to be smaller than 10 μm.

By reason of a similar thermal expansion of the sintered sliding bearing and the shaft with a corresponding selection of material (e.g. sintered iron/sintered bronze, steel shaft) a very small bearing play can be set and as a result radial displacements of the rotor shaft can be restricted and thus the noise emission of the pump can be reduced. Furthermore, the small bearing play prevents impurities (particles) in the medium to be conveyed from penetrating into the bearing gap and prevents the occurrence of jamming effects in the sliding bearing.

According to a further aspect of the invention, the porosity of the sintered sliding bearing is set to more than 40%.

As a result, the medium to be conveyed can be distributed rapidly and uniformly in the porous sintered sliding bearing, whereby reliable lubrication of the sliding bearing can be ensured. Moreover, the high pore content can promote the flow of the medium to be conveyed in the interior of the sliding bearing and thus the heat transportation from the sliding bearing to the medium to be conveyed.

According to a further aspect of the invention, the rotor can be formed in a pot-shaped manner, the inner face thereof faces the shaft seal and is fixed on the shaft axially intersecting the same.

As a result, liquid drops of a leakage downstream of the shaft seal are guided by radial acceleration on the inner face of the rotor forcibly through the air gap of the dry runner between the open field coils of the stator and the magnetic poles of the rotor before they can pass into a motor chamber containing electronics. The leakage drops are vaporised by the operating temperature of the electric motor and by a turbulent swirling movement in the air gap. Only then does the water vapour produced pass into the motor chamber and escape into the atmosphere through a membrane. As a result, it is possible to dispense with any encapsulation of the stator and to avoid the associated disadvantages of the level of efficiency of an electric motor of the wet runner type.

According to a further aspect of the invention, an axial mounting of the shaft is provided by an axial sliding bearing which is formed by a free end of the shaft and a thrust surface at the pump housing, preferably a pump cover.

During operation, the pump impeller generates a thrust in the direction of the intake connection or inlet of the pump. By virtue of an end-side slide surface of the shaft and a corresponding housing-side thrust surface, a particularly simple but sufficient axial bearing is provided without any necessary axial fixing in the opposite direction. As a result, the structure and assembly can be further simplified.

According to a further aspect of the invention, the shaft seal can comprise at least two sealing lips for sealing dynamically on the shaft circumference which are arranged to seal effectively towards at least one axial side.

By means of a double-lipped shaft seal, favourable and sufficient leakage protection is provided downstream of the axial sliding bearing, which in comparison with mechanical seals achieves considerably improved sealing and allows merely small accumulations of leakage drops to pass through. Sealing in the opposite direction, such as in the case of a pump structure having a dry rolling bearing can be omitted by reason of the wet-running sliding bearing.

According to a further aspect of the invention, the stator of the electric motor can be arranged in an axially intersecting manner with the at least one coolant flow channel.

By arranging one or in particular a plurality of coolant flow channels, which are distributed in the circumferential direction of the sliding bearing, in the sliding bearing adjacent to the stator of the electric motor, during operation a power loss of the field coils of the stator caused by heat transfer in the projection portion of the separating element is transmitted to the means to be conveyed, which circulates in the coolant flow channels of the sliding bearing, and is discharged to the flow to be conveyed in the pump chamber. This advantageous effect can also be utilised even in the case of small temperature differences between a high coolant temperature and a constantly even higher temperature of the coil windings.

According to a further aspect of the invention, a control unit can be provided which is arranged in the motor chamber in an axial direction between the separating element and the stator.

As a result, the control unit can be cooled by heat dissipation via the medium to be conveyed flowing in the porous sintered sliding bearing. Moreover, by reason of the spatial proximity between the control unit and the stator, the contacting or wiring between the control unit and the stator is simplified and a robust wire connection can be provided.

According to a further aspect of the invention, the motor chamber can comprise an opening to the atmosphere which is closed by a pressure equalizing membrane impermeable to liquid and permeable to vapor.

As a result, water vapor resulting from leakage drops in the motor chamber can be effectively discharged to the atmosphere.

The invention will be described hereinafter with the aid of an exemplified embodiment and with reference to the drawing in FIG. 1.

As can be seen in the axial sectional view in FIG. 1, a pump housing 1 comprises, on a side illustrated on the right, an intake connection 16 and a pressure connection, not illustrated, which issue into a pump chamber 10. The intake connection 16 serves as a pump inlet which is attached in the form of a separate pump cover 11 to an open axial end of the pump housing 10 and leads to an end side of a pump impeller 2 which is fixed on a shaft 4. The circumference of the pump chamber 10 is surrounded by a spiral housing which transitions tangentially to a pressure connection which forms a pump outlet.

The pump impeller 2 is a known radial pump impeller having a central opening adjoining the intake connection. The flow to be conveyed which flows towards the pump impeller 2 through the intake connection 16 is accelerated and diverted by the inner blades radially outwards into the spiral housing of the pump chamber 10.

On a side illustrated on the left, the pump housing 1 comprises a hollow space which is designated as a motor chamber 13 and is separated from the pump chamber 10 by a separating element configured as a support flange 12.

The support flange 12 is produced from a material having a high thermal conductivity, such as e.g. metal, in order to permit effective heat transfer between the motor chamber 13 and the pump chamber 10 or permit effective heat dissipation from the motor chamber 13 to the medium to be conveyed in the pump chamber 10. In the case of the exemplified embodiment shown in FIG. 1, the support flange 12 is produced from an aluminium alloy. The support flange 12 has a separating portion 12*a*, which provides the separation between the motor chamber 13 and the pump chamber 10, and a projection or projection portion 12*b* on which the stator 31 is attached or fixed.

As shown in FIG. 1, the pump housing 1 has a pot-shaped motor housing 17 which forms the motor chamber 13. The support flange 12 and the pump cover 11 are received in the motor housing 17 on an axial open side thereof, the support flange 12 abuts against a stop surface provided in the motor housing 17 and the pump cover 11 is fixed in this position on the motor housing 17. Disposed between the support flange 12 and the pump housing is a sealing element, such as e.g. an O-ring, in order to prevent a leakage of the medium to be conveyed in the pump chamber 10. As shown in FIG. 1, the sealing element in the case of the present exemplified embodiment is disposed on an outer circumferential surface of the separating portion 12*a* of the support flange 12, but the sealing element can also be disposed e.g. on the side surface of the separating portion 12*a* facing the pump cover 11 in the axial direction. The above-described configuration permits simple and exact positioning of the support flange 12 and the pump cover 11 in the radial direction.

A brushless electric motor 3 of the outer-runner type is accommodated in the motor chamber 13. A stator 31 having field coils of the electric motor 3 is fixed around the projection portion 12*a* of the support flange 12 which has e.g. a cylindrical configuration and so the stator 31 is in contact with the projection portion 12*a*. This ensures very effective heat dissipation from the stator 31 in the motor chamber 13 via the support flange 12 to the medium to be conveyed in the pump chamber 10. A rotor 32 having permanently magnetic rotor poles is fixed on the shaft 4 so as to be rotatable about the stator 31.

A control unit or circuit board 18, shown in FIG. 1, of the pump including power electronics of the electric motor 3 is disposed in the axial direction between the separating portion 12*a* of the support flange 12 and the stator 31. By reason of the spatial proximity between the circuit board 18 and the support flange 12 on the one hand and the stator 31 and the circuit board 18 on the other hand, in this case effective heat dissipation from the circuit board 18 via the support flange 12 to the medium to be conveyed can be facilitated and good prerequisites are provided for simple and robust contacting or wiring between the circuit board 18 and the electric motor 3.

Disposed in the air gap between the separating portion 12*a* and the circuit board 18 can be a filling material 19, such as a gap filler, having a high thermal conductivity and so the heat transfer from the circuit board 18 to the medium to be conveyed in the pump chamber 10 can be further improved.

However, the circuit board 18 of the pump can also be arranged at a different location in the motor chamber 13, such as on the base portion of the motor housing 17 facing the axial end of the electric motor. Furthermore, the circuit board 18 of the pump can also be arranged outside the motor chamber 13.

The electric motor 3 is a dry runner type, of which the field coils are exposed in a non-encapsulated or open manner with respect to the motor chamber 13 at the air gap to the rotor 32. The rotor 32 has a cup shape which is typical of an outer runner and is seated on the free end of the shaft 4 illustrated on the left and supports the permanently magnetic rotor poles in the axial region of the stator 31.

The shaft 4 which extends between the pump chamber 10 and the motor chamber 13 is mounted in a radial manner in the support flange 12 by means of a radial sintered sliding bearing 41. Moreover, the shaft 4 is mounted in an axial manner on the right, free end. The axial sliding bearing is established by means of a slide surface pairing between the end side of the shaft 4 and a thrust surface which is provided positioned accordingly on the pump cover 11 by means of a projection or a strut in the intake connection 16 upstream of the pump impeller 2. During operation, the pump impeller 2 pushes the shaft 4 by means of a suction effect in the direction of the intake connection 16 against the thrust surface and so axial load absorption of the shaft mounting is sufficient in this one direction. Since a bearing gap between the slide surfaces is surrounded by the flow to be conveyed, the axial sliding bearing is also lubricated with coolant, at least in the form of an initial wetting of the slide surfaces by the coolant and renewed wetting of said slide surfaces under vibration and turbulence.

The coolant-lubricated sliding bearing 41 is designed as a sintered bearing having a defined porosity of more than 40%, for which e.g. known standard materials for sintered sliding bearings, such as sintered iron and sintered bronze, can be used. By selecting such sintered materials, very small bearing play of smaller than 10 μm can be set when using a steel shaft by reason of the initial heat expansion of the sintered bearing and steel shaft. Therefore, radial displacements of the rotor shaft can be largely suppressed and the noise emission of the pump can be reduced. Moreover, the porous sintered material is rapidly filled with the medium to be conveyed and thus permits efficient absorption and dissipation of the heat generated in the sliding bearing itself and of the heat transmitted by other pump elements to the sliding bearing, into the medium to be conveyed.

The sintered sliding bearing 41 shown in FIG. 1 also has two axial coolant flow channels 14 with a predetermined depth starting from the end of the sintered sliding bearing 41 on the side of the pump chamber 10. Therefore, the medium to be conveyed can be recirculated during pump operation by reason of the prevailing pressure ratios in the pump in a defined flow direction starting from the radial outer region of the pump chamber 10 at high pressures via the region of the pump chamber 10 between the pump impeller 2 and the support flange 12 at radially inwardly decreasing pressures, through the coolant flow channels 14 and the axial end portion of the sliding bearing 41 on the side opposite the pump impeller 2 without a coolant flow channel 14 (filter portion) to the space between the sintered sliding bearing 41 and the shaft seal 5, through the bearing gap of the sliding bearing 41 and finally to the radial inner region of the pump chamber 10 with even lower pressures. The axial circulation of the coolant in the bearing gap in combination with the rotational movement between the slide surfaces ensures uniform distribution and lubrication of the bearing gap with the coolant. The coolant contains a frost protection additive having a friction-reducing property, such as e.g. a glycol, silicate or the like. At the same time, particles arising from abrasion of the slide surface pairing are transported away to the pump chamber and into the flow to be conveyed.

Although FIG. 1 illustrates two coolant flow channels 14, it is adequate in accordance with the invention if at least one such coolant flow channel 14 is provided. Furthermore, it is also possible for more than two coolant flow channels 14 to be provided. In the case of the example illustrated in FIG. 1, the coolant flow channels 14 are designed as grooves on the outer circumference of the sintered sliding bearing 41. However, the coolant flow channels 14 can also be provided as axially extending blind hole bores in the sintered sliding bearing 41. Furthermore, the at least one coolant flow channel 14 which is designed as a groove can be formed in a spiral-shaped manner around the circumference of the sintered sliding bearing 41.

By means of the defined coolant flow explained above, the slide surfaces at the shaft circumference and at the bearing seat of the sliding bearing 41 are lubricated by means of the coolant which is conveyed by the additional water pump and penetrates into the bearing gap between the slide surfaces. In this regard, the porous sintered sliding bearing 41 also serves as a filter element for the through-flowing medium to be conveyed and so exclusively filtered coolant passes in front of the shaft sealing ring and into the bearing gap. Therefore, a separate filter element for the medium to be conveyed is not necessary.

Disposed between the radial sintered sliding bearing 41 and the motor chamber 13 is a shaft seal 5 which seals an open end of the projection portion 12*b* of the support flange 12 with respect to the shaft 4. The shaft seal 5 is a double-lipped seal which is pressed into the projection portion 12*b* of the support flange 12 and has two sealing lips (not illustrated) which are located one behind the other and are directed in the direction of the radial sliding bearing 41 for one-sided dynamic sealing on the shaft circumference.

However, the small unavoidable leakage which passes from the circulation of the coolant in a dropwise manner through the shaft seal 5 over the course of time does not come directly into contact with the field coils or any motor electronics arranged in the motor chamber 13. During operation, the leakage drops pass downstream of the shaft seal 5 to the inner face of the rotating rotor 32 and are carried radially outwards by the centrifugal force. By reason of swirling movements at the rotor poles or permanent magnets and by reason of the operating temperature resulting from the power loss at the field coils, the leakage drops vaporise in the air gap between the stator 31 and the rotor 32 without being able to exert wetting in a liquid phase, i.e. a corrosive effect, on the radially inner stator 32.

By reason of the cup shape of the rotor 32, the leakage drops cannot pass directly in the axial direction into the motor space 13 but instead are collected on the inner face of the rotor 32 and directed to the air gap for vaporisation. In order to minimise a volume of the air gap, the air gap is configured to be complementary to the circumferences of the stator 32.

The transition of leakage drops from the liquid phase to the gaseous phase is associated with a volume increase which, in the case of a closed volume of the motor chamber 13, would lead to a pressure increase, irrespective of a pressure fluctuation which would result by reason of temperature fluctuations between operation and non-operation of the pump.

However, between the motor chamber 13 and the surrounding atmosphere a membrane, not illustrated in FIG. 1, is provided which is attached to the cup-shaped motor housing 17 in the motor chamber 13. The membrane can be provided in an opening 20, illustrated in FIG. 1, of the motor housing 17 in the outer circumference of the motor housing 17. Furthermore, the membrane can be adhered in a radially central portion of an inner face of the motor housing 17 facing the rotor in the axial direction and allows the equalisation of pressure fluctuations from the motor chamber 13 to the atmosphere. As a result, a cost-effective and large-area adhesive membrane can be used at a protected location. The motor housing 17 then has in this region an opening or a permeable or open-pored structure which is configured such that the membrane is sufficiently protected and is not damaged during high pressure jet tests. The membrane is semi-permeable in relation to water-permeability, i.e. it does not allow water in a liquid phase to pass through, whereas moisture-laden air can diffuse through up to a limit in relation to a droplet size or a droplet density agglomerating at the membrane surface. Therefore, during a volume expansion caused by vaporisation in the motor chamber 13, moisture-laden warm air can pass through the membrane and so vaporised leakage drops are effectively discharged into the atmosphere. In the opposite direction, the membrane protects, in turn, against the ingress of splash water or the like during the drive operation of the vehicle.

The invention claimed is:

1. An electrical coolant pump for conveying coolant in a vehicle comprising:

a pump housing with a pump chamber in which a pump impeller is rotably accommodated, an inlet and an outlet which are connected to the pump chamber;

a shaft which is rotably supported at a separating element between the pump chamber and a motor chamber separated from the pump chamber, and on which the pump impeller is fixed;

a dry-running electric motor with a radially inner stator and a radially outer rotor which is accommodated in the motor chamber;

wherein a radial bearing of the shaft, which is arranged in an axial direction between the pump impeller and the rotor, is provided by means of a radial sintered sliding bearing having a defined porosity lubricated by coolant; and a shaft seal is arranged between the radial sliding bearing and the motor chamber;

wherein at least one coolant flow channel with a predetermined depth is provided in the sintered sliding bearing in an axial direction extending from the end of the sintered sliding bearing on the side of the pump chamber.

2. The electrical coolant pump according to claim 1, wherein the coolant flow channel extends in the axial direction from the end of the sintered sliding bearing on the side of the pump chamber across 90% of the component depth of the sintered sliding bearing.

3. The electrical coolant pump according to claim 1, wherein the bearing play in the sintered sliding bearing of the shaft is set to be smaller than 10 μm.

4. The electric coolant pump according to claim 1, wherein the porosity of the sintered sliding bearing is set to more than 40%.

5. The electric coolant pump according to claim 1, wherein the rotor is formed in a pot-shaped manner, the inner face thereof faces the shaft seal and is fixed on the shaft axially intersecting the same.

6. The electric coolant pump according to claim 1, wherein an axial mounting of the shaft is provided by an axial sliding bearing which is formed by a free end of the shaft and a thrust surface at the pump housing, preferably a pump cover.

7. The electric coolant pump according to claim 1, wherein the shaft seal comprises at least two sealing lips for sealing dynamically on the shaft circumference which are arranged to seal effectively towards at least one axial side.

8. The electric coolant pump according to claim 1, wherein the stator of the electric motor is arranged in an axially intersecting manner with the at least one coolant flow channel.

9. The electric coolant pump according to claim 1, further comprising a control unit which is arranged in the motor chamber in an axial direction between the separating element and the stator.

10. The electric coolant pump according to claim 1, wherein the motor chamber comprises an opening to the atmosphere which is closed by a pressure equalizing membrane impermeable to liquid and permeable to vapor.

11. A use of an electric coolant pump according to claim 1 as a supplementary water pump in a system carrying coolant in a vehicle with a combustion machine and a main water pump.

* * * * *